United States Patent [19]

McVickar et al.

[11] 3,985,115

[45] *Oct. 12, 1976

[54] HOT AIR FURNACE

[75] Inventors: Dan B. McVickar; Adolf Wolf, both of Holland, Mich.

[73] Assignee: Lear Siegler, Inc., Holland, Mich.

[ * ] Notice: The portion of the term of this patent subsequent to Feb. 12, 1991, has been disclaimed.

[22] Filed: Feb. 25, 1975

[21] Appl. No.: 552,945

Related U.S. Application Data

[63] Continuation of Ser. No. 425,154, Dec. 17, 1973, abandoned, which is a continuation-in-part of Ser. No. 202,126, Nov. 26, 1971, Pat. No. 3,794,014.

[52] U.S. Cl. ..... 126/110 AA; 29/157.3 A; 126/110 R

[51] Int. Cl.[2] ..... F24H 3/10

[58] Field of Search ..... 165/130, 131, 128, 129; 126/110 R, 110 AA, 116 R, 110 B; 122/367 R, 367 C; 29/157.3 A

[56] References Cited

UNITED STATES PATENTS

| | | | |
|---|---|---|---|
| 2,289,206 | 7/1942 | Nessell | 126/110 B |
| 2,386,746 | 10/1945 | Hess | 126/110 B |
| 2,431,772 | 12/1947 | Russell | 126/110 R |
| 2,620,787 | 12/1952 | Zink | 126/110 B |
| 2,625,150 | 1/1953 | Little | 126/110 AA |
| 2,936,517 | 5/1960 | Brown, Jr. et al. | 29/157.3 A |
| 3,002,729 | 10/1961 | Welsh | 29/157.3 A |
| 3,010,449 | 11/1961 | Owen | 126/110 B |
| 3,367,310 | 2/1968 | Whitlow et al. | 126/110 R |
| 3,431,772 | 12/1947 | Russell | 126/110 R |
| 3,627,038 | 12/1971 | Wilkins | 126/110 AA |
| 3,794,014 | 2/1974 | McVickar et al. | 126/110 AA |

FOREIGN PATENTS OR APPLICATIONS

| | | | |
|---|---|---|---|
| 1,266,823 | 6/1961 | France | 165/83 |

*Primary Examiner*—John J. Camby
*Assistant Examiner*—Henry C. Yuen
*Attorney, Agent, or Firm*—Price, Heneveld, Huizenga & Cooper

[57] ABSTRACT

A hot air furnace includes a cylindrical combustion chamber with enclosed upper and lower ends. A plurality of apertures are formed in the lower end of the combustion chamber wall through which flame jets are radially discharged into a flue chamber defined by the space between the combustion chamber wall and a flue chamber wall circumscribing and spaced from the combustion chamber wall. The end of the flue chamber wall nearest the apertured end of the combustion chamber is closed with a domed panel and the opposite end is closed with a streamlined closure member. A plurality of vertically extending fins extend a substantial distance between the combustion chamber wall and flue chamber wall along a portion of the length of said flue chamber wall spaced from the apertures in the combustion chamber wall. An air chamber wall circumscribes and is spaced from the flue chamber wall which includes a plurality of vertically extending fins disposed in the air chamber so formed to surround the flue chamber wall. Blower means forces air over the streamlined exterior surface of one end of the flue chamber wall and along the finned exterior thereof to transfer heat from the furnace.

12 Claims, 4 Drawing Figures

HOT AIR FURNACE

CROSS REFERENCE TO OTHER APPLICATIONS

This is a continuation of application Ser. No. 425,154 filed Dec. 17, 1973, now abandoned, which is a continuation-in-part of our copending application Ser. No. 202,126 filed Nov. 26, 1971, and entitled HOT AIR FURNACE now U.S. Pat. 3,794,014 issued Feb. 26, 1974.

BACKGROUND OF THE INVENTION

This invention relates to furnaces and more particularly to an improved hot air furnace.

Although a wide variety of hot air furnaces are commercially available today, there is a continuing need for new and improved hot air furnaces. For example, with the recent increase in popularity of mobile homes and modular and apartment housing, there has been a great deal of interest in reducing the size of hot air furnaces while maintaining high heat capacities. However, reducing the size of conventional hot air furnaces while maintaining high heat results in several problems. One problem, for example, is durability, since as the size decreases, the high heat capacity tends to be more destructive to the structural components of the furnace.

Another problem is versatility. In mass producing large numbers of small furnaces, it becomes increasingly desirable to have such furnaces interchangeably useful with either gas or oil burners and interchangeable as to air flow direction. In mobile homes, for example, there is generally a requirement for a downward air flow while in residential homes there is generally a requirement for an upward air flow where the furnaces are often located in basements.

In some high efficiency furnaces, large flat surfaces on the heat exchanger flex during each firing of the furnace as the temperature rapidly increases, causing a loud undesirable noise generally referred to as "tin-canning". It is desirable, therefore, to design the heat exchanger to eliminate this objectionable noise.

Also, in furnaces where blower means direct air over the exterior of a flue chamber, to reduce flow resistance and, therefore, increase air flow efficiency, it is desirable to streamline the exterior of the flue chamber. Finally, heat transfer fins configurated to maximize heat transfer in the furnace while resisting wear and still being easy to manufacture are desirable.

SUMMARY OF THE INVENTION

A furnace constructed according to the present invention provides an improved hot air furnace which can be efficiently manufactured in small sizes with high heat capacities, which is durable, quiet operating and which is versatile as to both the type of burners used and provides efficient air flow in the direction required by either upflow or downflow applications.

The improved hot air furnace of the present invention includes a combustion chamber having closed ends and a cylindrical combustion chamber wall with a plurality of apertures in the lower end of the combustion chamber wall. A flue chamber wall surrounds and is spaced from the combustion chamber wall to define a flue chamber therebetween, the bottom of the flue chamber being domed and the streamlined top being coupled to a flue pipe for exhausting gases from the combustion and flue chambers. A plurality of vertically extending fins are coupled to opposite sides of the flue chamber wall to extend inwardly a substantial distance toward the combustion chamber wall along a portion of the combustion chamber wall and spaced from the apertures therethrough, and to extend radially outwardly toward an air chamber wall surrounding the flue chamber wall and forming an air chamber therebetween. A blower is coupled to one end of the air chamber and directs air over a streamlined end of the flue chamber and through the air chamber. Burner means is positioned with the burner nozzle in the combustion chamber for firing the furnace.

DETAILED DESCRIPTION OF THE PREFERRED EMBODIMENT

Figure 1:
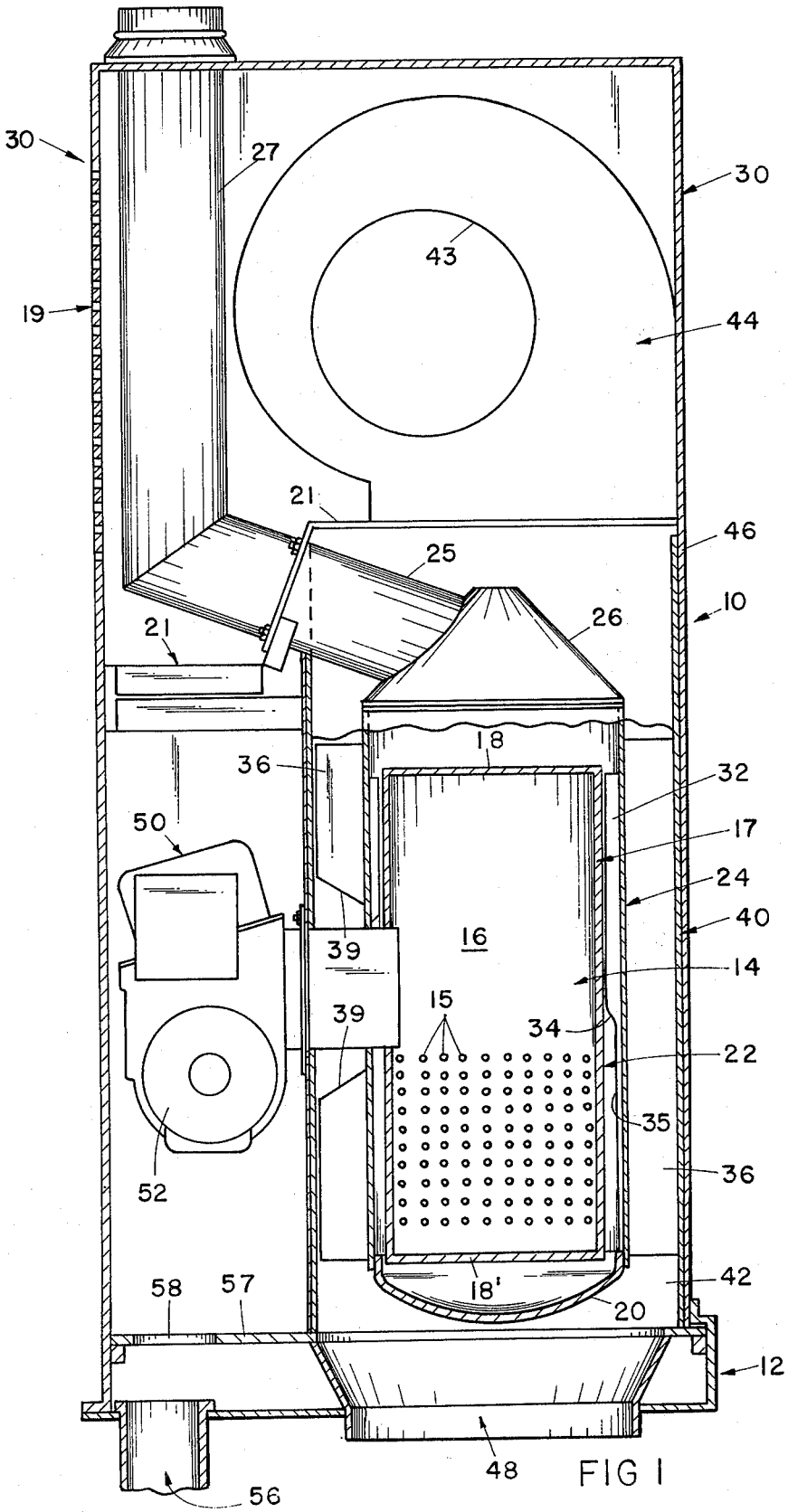
FIG. 1 is a side elevational, cross-sectional view of the furnace of the present invention.

Referring now to FIG. 1, there is shown a hot air furnace 10 positioned on a supporting base assembly 12 and including a heat exchanger 14. Heat exchanger 14 comprises a combustion chamber 16 having a cylindrical side wall 17, a flat top 18 enclosing the upper portion of the chamber, and a flat bottom 18'.

Combustion chamber 16 has a plurality of apertures 15 formed in the lower end of wall 17 as best seen in FIG. 1. The number, size, spacing and pattern of apertures 15 will depend on the total heat transfer rate desired, since as discussed more fully hereinafter, small jets of flame shoot out of apertures 15 into a flue chamber 22, one function of which is to add to the overall heat transfer of te heat exchanger. Since the pressure in the combustion chamber 16 resulting from the burner unit will affect the extent to which the jet flames shoot out of the apertures, this pressure should also be taken into account in determining the number, size, spacing and pattern of apertures 15. In general, however, it is preferred that apertures 15 are of small size, e.g., about ⅛ inch diameter, and are located substantially around the entire circumference of the lower end of the cylindrical wall of the combustion chamber for uniform heat transfer.

Figure 2:
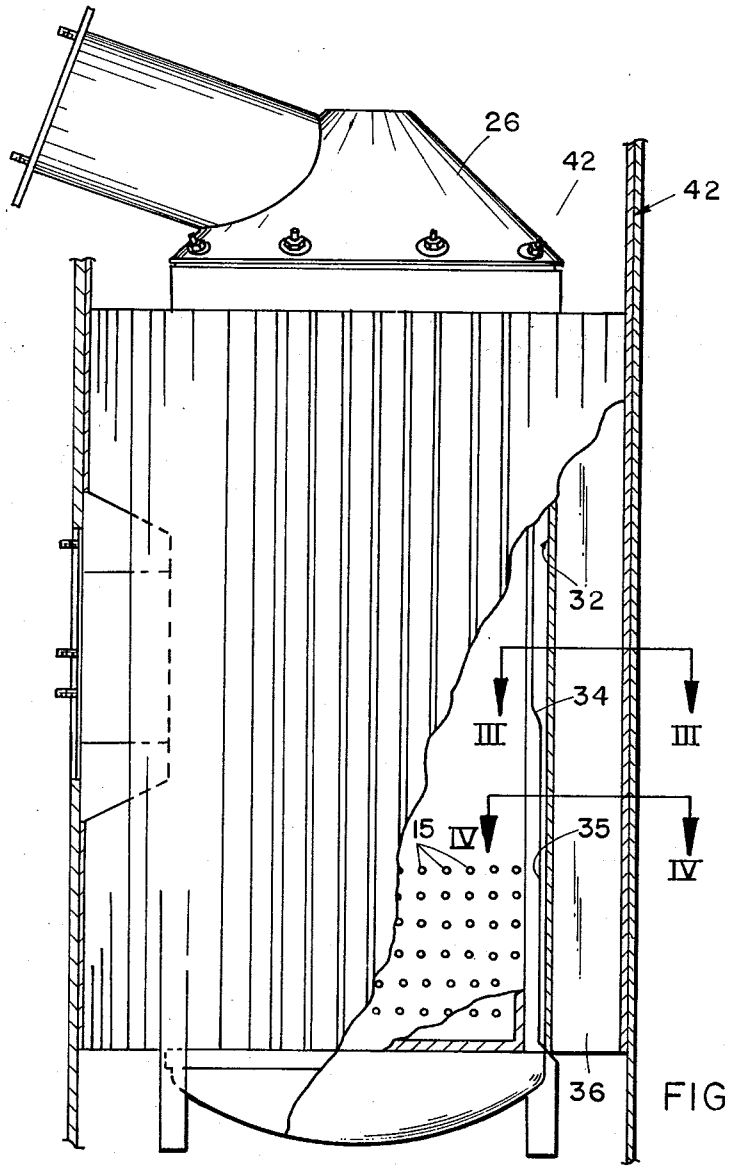
FIG. 2 is an enlarged, fragmentary cross-sectional view of a portion of the furnace shown in FIG. 1.

The flue chamber 22 is defined by the space between a flue chamber wall 24 positioned to surround wall 17 of combustion chamber 16 and spaced therefrom. The lower end of chamber 22 is sealed by an outwardly domed panel 20 as seen in FIGS. 1 and 2. This predistorted panel near the hot end of the combustion chamber prevents tin-canning and assures quiet furnace operation during the initial firing of the furnace for each heating cycle and as the furnace cools after a heating cycle. Wall 24 extends upwardly above top 18 of the combustion chamber and terminates in a frustoconical cover 26 to which an exhaust flue 25 is coupled. To permit removal of the combustion chamber, one of the ends 20 or 26 is removable attached to the flue chamber. In the downflow furnace shown, end 26 is bolted to wall 24, as seen in FIG. 2, while domed panel 20 is welded in place. Exhaust stack 27 extends from flue 25 upwardly and externally of the sheet metal shell 30 of furnace 10 to a chimney (not shown) for exhausting gases from the furnace.

Figure 3:
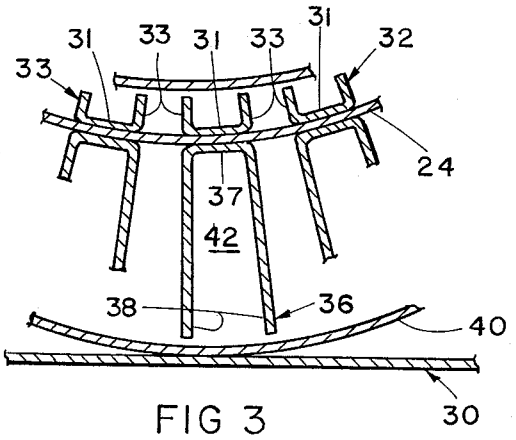
FIG. 3 is an enlarged, fragmentary cross-sectional view taken along section lines III—III of FIG. 2.
Figure 4:
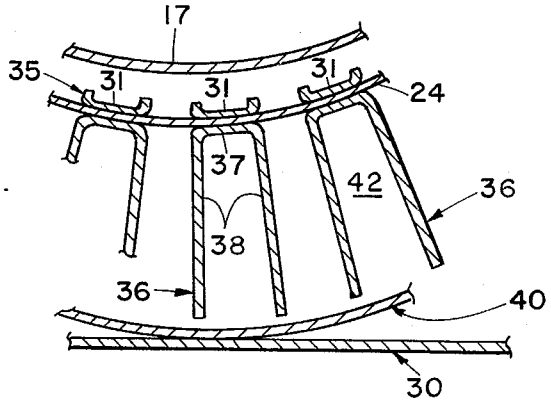
FIG. 4 is an enlarged, fragmentary cross-sectional view taken along section lines IV—IV of FIG. 3.

Extending radially inwardly from the flue chamber wall 24, as best seen in FIGS. 2, 3, and 4, is a plurality of fins 32 which are mounted to extend vertically along wall 24. Fins 32, as seen in FIG. 3, are generally U-shaped having a base 31 mounted to wall 24 and a pair of spaced legs 33. Fins 32 extend into the flue chamber a significant distance toward the exterior surface of the combustion chamber and extend vertically downwardly from the top of the flue chamber wall toward the lower end of the flue chamber. The legs 33, however, are cut at 34 along a tapered line (FIG. 2) leaving only a stub U-shaped portion 35 adjacent the jets 15 of the combustion chamber.

The stub 35 is integral with inwardly projecting fins 32 and permits continuous seam welding of the base 31 of fins 32 to the flue chamber wall 24 at the same time as outwardly radially extending fins 36 are mounted to wall 24. Fins 36 are also generally U-shaped with a base 37 and legs 38. These fins, as best seen in FIG. 1, extend vertically along the entire length of the flue chamber wall and radially outwardly a significant distance toward an air chamber wall 40 (FIGS. 3 and 4).

Fins 32 and 36 are simultaneously secured to substantially the entire circumference of cylindrical wall 24 by abutting bases 31 and 37 of the fins, respectively, in alignment on opposite sides of the wall. By providing stubs 35, the continuous seam welding process made possible thereby eliminates uneven application of the welded seams which might cause localized areas of weakness subject to failure. Thus, the disclosed fin structure does not require complex tooling necessary if the members to be properly welded on opposite sides of wall 24 were of different lengths.

Thus, fins 32 are effective in transferring heat from the combustion chamber to the flue chamber wall by conduction and convection but are not destructively burned by flames shooting out from the jets 15 of the combustion chamber at the lower portion of the chamber. Fins 36 in turn transfer heat from the flue chamber wall outwardly toward air chamber wall 40 which substantially surrounds the flue chamber and is spaced therefrom.

The air chamber 42 defined by the space between the exterior of the flue chamber wall and end and the interior of the air chamber wall 40 provides a flow path for air forced through the air chamber from a blower 44 mounted to a plenum chamber 46 sealably coupled to the upper portion of the air chamber wall 40. The air flow is downwardly through the air chamber 42 to transfer heat from the flue chamber wall facilitated by fins 36, through a feeder duct 48 sealably coupled to the bottom of the air chamber wall 40 in the downdraft furnace of the preferred embodiment.

The frusto-conical streamlined end cover 26 of the flue chamber not only facilitates the exhausting of gases from the flue chamber into exhaust duct 25, it also promotes streamlined air flow through the air chamber 42 to transfer heat from the heat exchanger 14 since it presents a selectively streamlined surface to the flow of air. Heat from the furnace is transferred to the mobile home or other unit in which the furnace is installed by means of conventional heating ducts coupled to the feeder duct 48 of the furnace 10. Return air grill 19 (FIG. 1) supplies returned cold air to the furnace which air is drawn into air intake 43 of blower 44 to be recirculated and heated by furnace 10. Sealing plate 21 seals the blower unit from the lower portion of the furnace.

The furnace is fired by means of a burner unit 50 including a burner motor 52 for supplying fuel oil which is ignited by conventional ignitor means associated with the burner unit. Fins 36 are cut away at area 39 (FIG. 1) to accommodate the burner unit. Combustion air for the furnace burner unit flows through air duct 56, thereafter through opening 58 formed in the floor 57 of the furnace, and into the air intake of burner 50. In some installations, the furnace can alternately include openings in the wall 30 adjacent the burner to supply the required combustion air.

Thus, by the construction shown in FIGS. 1–4, very efficient heat transfer from combustion chamber 16 to air chamber 42 results. First, the firing of the burner 50 into combustion chamber 16 causes the entire combustion chamber wall, which is preferably stainless steel, to glow and radiate heat to flue chamber wall 24. Second, the jets of flame out of apertures 15 transfer heat to the lower portion of the flue chamber wall by jet heat transfer. Third, the spent gases from the jets flow upward and uniformly transfer heat to flue chamber wall 24 by convection and conduction through the fins 32. Finally, the heat which reaches flue chamber wall 24 is transferred by conduction into fins 36 and therefrom via convention to air flowing between fins 36 in air chamber 42. The heated air is then transferred to the ducting via feeder duct 48 by blower means 44.

There are several advantages to the construction of the furnace of the present invention. The described construction permits a high and efficient rate of heat transfer. With a furnace of small size, e.g., on the order of between about 3 and 4 feet high, 1 to 2 feet wide, and 1½ to 2 feet deep, heat inputs of between about 60,000 and about 200,000 BTU's per hour are possible. In addition, the construction is very durable since the absence of large temperature gradients, i.e., the absence of regions of abrupt and extreme heat changes, results in low stress levels giving long life to the metallic components of the furnace.

Furthermore, the preferred annular construction of the flue chamber with the domed bottom end and streamlined top, and the air chamber, produces optimum heat transfer and eliminates the undesirable noises of conventional rectangular or flat constructions. Also, the construction is interchangeable between an upward air flow and a downward air flow furnace by positioning the blower at the opposite end and shifting the heat exchanger. Finally, the streamlined and unobstructed air chamber 42 allows the blower, the air chamber, and the ducting to be used for high capacity air conditioning cold air passage.

While the preferred embodiments of the present invention have been described and illustrated, it will be obvious that various modifications can be made without departing from the scope of the invention. Accordingly, the scope of the invention is to be limited only by the appended claims.

The embodiments of the invention in which an exclusive property or privilege is claimed are defined as follows:

1. A hot air furnace comprising:

a combustion chamber having a continuous side wall and closed ends;

a flue chamber wall surrounding and spaced from said combustion chamber side wall and closed at one end;

a closure member for the opposite end of said flue chamber wall including a flue pipe extending therefrom and communicating with the flue chamber defined in part by the space between said combustion chamber wall and said flue chamber wall;

an air chamber wall surrounding and spaced from said flue chamber wall to define an air chamber therebetween; and first and second sets of U-shaped fin members, one on each side of said flue chamber wall, each set including a plurality of separate elongated U-shaped fin members each having base portions positioned on one side of said flue chamber wall to be aligned directly opposite a base portion of a fin member of the other set of fin members positioned on the other side of said flue chamber wall and opposed and aligned fin members seam welded to said flue chamber wall, said fin members having a pair of legs extending from said base portions a substantial distance to provide fins in at least portions of said flue chamber and in at least portions of said air chamber; said combustion chamber wall including a plurality of apertures formed therethrough near one end and wherein each base portion of said fin members of said first set extends substantially along the length of said flue chamber wall, said fins of said first set formed by said pair of legs along only portions of the length of said flue chamber wall remote from said apertures in said combustion chamber wall extending from said flue chamber wall a significant distance toward said combustion chamber, and said legs of each fin of said first set of fins being stub portions adjacent the apertured end of said combustion chamber.

2. A hot air furnace comprising:

a combustion chamber having a continuous side wall and closed ends, said side wall including a plurality of apertures of relatively small size formed through said wall and located substantially around the periphery of said combustion chamber wall adjacent one closed end of said chamber;

a flue chamber wall surrounding and spaced from said combustion chamber side wall and closed at one end by a curvilinear panel;

a closure member for the opposite end of said flue chamber wall including a flue pipe extending therefrom and communicating with the flue chamber defined in part by the space between said combustion chamber wall and said flue chamber wall;

a plurality of first fins coupled to said flue chamber wall and extending toward said combustion chamber wall a significant distance along a portion of the length of said fins remote from said apertures in said combustion chamber wall;

an air chamber wall surrounding and spaced from said flue chamber wall to define an air chamber therebetween;

a plurality of second fins coupled to said flue chamber wall and extending toward said air chamber wall;

blower means coupled to an end of said air chamber; and a burner including a burner nozzle and ignition means extending into said combustion chamber whereby jets of flame are permitted to shoot out of said combustion chamber into said flue chamber via said apertures.

3. The apparatus as defined in claim 2 wherein said curvilinear panel curves outwardly from said flue chamber.

4. The apparatus as defined in claim 2 wherein said closure member for said flue chamber wall has a streamlined exterior surface.

5. The apparatus as defined in claim 2 wherein said closure member is frusto-conical in shape.

6. The apparatus as defined in claim 2 wherein each of said first fins comprises a base extending substantially along the length of said flue chamber wall and a pair of legs extending outwardly from opposite edges of said base, said legs shaped to extend a significant distance toward said combustion chamber wall along a major portion of the length of said fins, which portion is remote from said one closed end of said combustion chamber.

7. The apparatus as defined in claim 6 wherein said legs of each of said first fins are cut away toward said base thereof to define a stub section adjacent the apertured end of said combustion chamber.

8. A hot air furnace comprising:

a combustion chamber having a continuous side wall and closed ends, said side wall including a plurality of apertures formed therethrough and adjacent one closed end of said chamber;

a flue chamber wall surrounding and spaced from said combustion chamber side wall and closed at one end;

a streamlined closure member for the opposite end of said flue chamber wall including a flue pipe extending therefrom and communicating with the flue chamber defined in part by the space between said combustion chamber wall and flue chamber wall;

a plurality of first fins coupled to said flue chamber wall and extending toward said combustion chamber wall a significant distance along a portion of the length of said fins remote from said apertures in said combustion chamber wall;

an air chamber wall surrounding and spaced from said flue chamber wall to define an air chamber therebetween;

a plurality of second fins coupled to said flue chamber wall and extending toward said air chamber wall;

blower means coupled to an end of said air chamber adjacent said closure member for said flue chamber wall; and a burner including a burner nozzle extending into said combustion chamber for firing said furnace.

9. The apparatus as defined in claim 8 wherein said one closed end of said flue chamber is a curvilinear panel.

10. The apparatus as defined in claim 9 wherein each of said first fins comprises a base extending substantially along the length of said flue chamber wall and a pair of legs extending outwardly from opposite edges of said base, said legs shaped to extend a significant distance toward said combustion chamber wall along a major portion of the length of said fins and remote from said one closed end of said combustion chamber.

11. The apparatus as defined in claim 10 wherein said legs of each of said first fins are cut away toward said base thereof to define a stub section adjacent the apertured end of said combustion chamber.

12. The apparatus as defined in claim 11 wherein said closure member is frusto-conical in shape.

* * * * *